United States Patent [19]

Weir

[11] Patent Number: 4,991,326

[45] Date of Patent: Feb. 12, 1991

[54] AIR CLAMP FOR LAUNDRY HANDLING APPARATUS

[76] Inventor: Henry J. Weir, The Willows, Woodcroft, Gwent, United Kingdom

[21] Appl. No.: 347,986

[22] Filed: May 5, 1989

[30] Foreign Application Priority Data

Jun. 5, 1988 [GB] United Kingdom ..... 8810683

[51] Int. Cl.[5] ..... D06F 67/04

[52] U.S. Cl. ..... 38/143; 414/751

[58] Field of Search ..... 414/751, 468.2; 198/803.1, 465.1; 26/94; 269/13; 38/8, 12, 143

[56] References Cited

U.S. PATENT DOCUMENTS

| | | | |
|---|---|---|---|
| 4,106,227 | 8/1978 | Allen et al. | 38/143 |
| 4,378,645 | 4/1983 | Allen et al. | 38/8 |
| 4,411,083 | 10/1983 | Weir | 38/143 |
| 4,557,371 | 12/1985 | Yonezawa | 18/803.01 |

FOREIGN PATENT DOCUMENTS

| | | | |
|---|---|---|---|
| 1513669 | 1/1967 | France . | |
| 1105342 | 3/1968 | United Kingdom . | |
| 2098633 | 11/1982 | United Kingdom | 38/8 |
| 2099025 | 12/1982 | United Kingdom | 38/8 |

OTHER PUBLICATIONS

UK Patent Application, No. 8813109.9, Jun. 3, 1988, Weir.

*Primary Examiner*—Andrew M. Falik

*Attorney, Agent, or Firm*—Wallenstein, Wagner & Hattis

[57] ABSTRACT

A laundry article handling apparatus comprises at least one article clamp having a fluid pressure operated for closing a clamp to hold an article therein, a system for moving the clamp between an article receiving an article release position, a source of pneumatic pressure having an outlet disposed at the article receiving position, the fluid pressure operated system having an inlet configured to connect to and disconnect from the outlet to be charged therefrom when so connected thereto, and further having a valving system which will retain the pneumatic pressure supplied thereto after disconnection from the outlet. The valve release system is arranged to release pneumatic pressure from the system at the release position to allow the article to be released from the clamp.

27 Claims, 5 Drawing Sheets

FIG. 2.
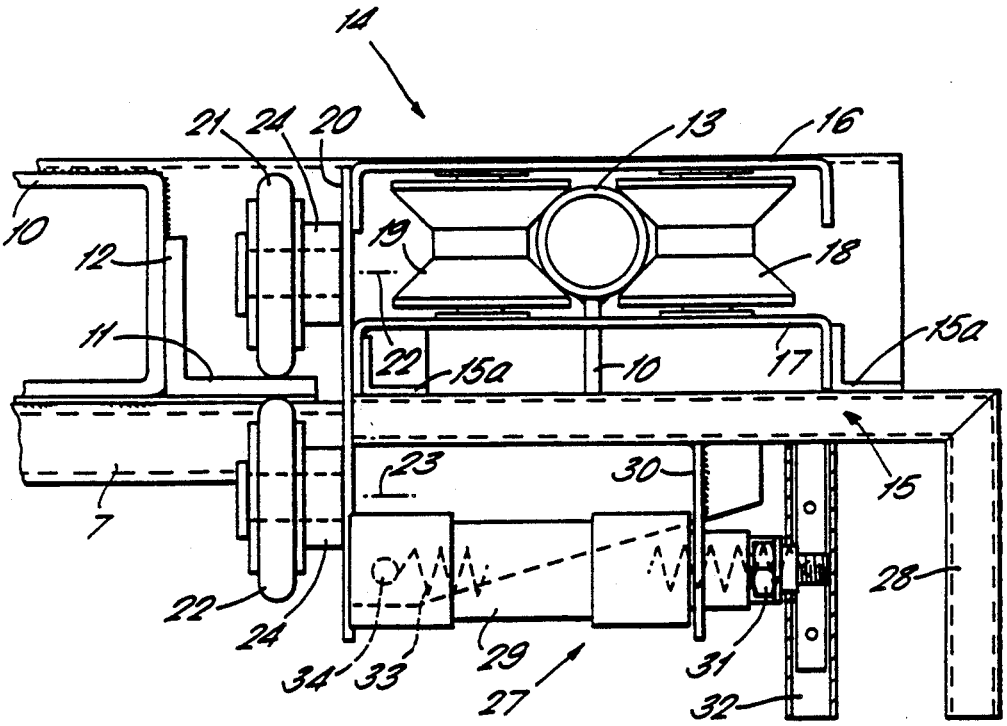
FIG. 3.A.
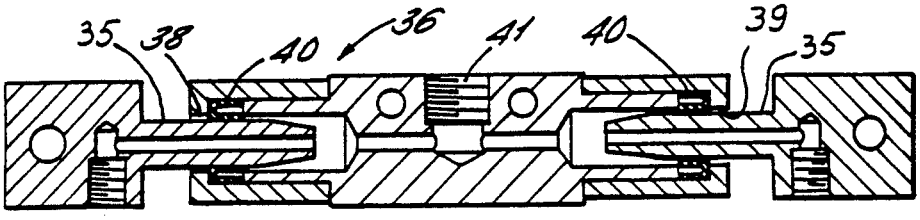
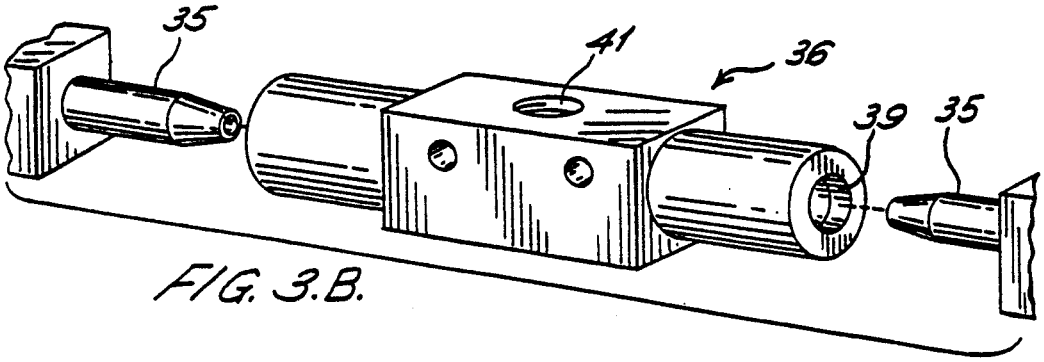
FIG. 3.B.

AIR SOURCE
CONTROL
TIMER
TIMER 4A
4B
25
27
28
29
32
35
36
38
39
42
43
43a
44
45
46
47
60
61
62
63
64
65
80

AIR CLAMP FOR LAUNDRY HANDLING APPARATUS

DESCRIPTION

1. Technical Field

This invention relates to laundry article handling apparatus and in particular to apparatus for feeding laundry articles (usually flat-work articles such as bedsheets, tablecloths, pillow cases and the like) to machines for further processing of the articles such as ironing machines.

2. Background of the Invention

Typically, in such applications, automatic feeding systems are employed generally comprising a conveyor on which the laundry articles are laid for feeding to a commercial ironer. Such feeding systems may comprise carriages movable along guideways and carrying clipping means for gripping adjacent corners or edges of the particular article. When the carriages, each with its respective clipping means, are drawn apart, the leading edge of the article is centered and stretched across the conveyor entry. Subsequently, the article is released from the clipping means and transferred over the inlet end surface of the automatic feeding conveyor by a transfer mechanism. Several devices are known in the art which center and spread laundry on an automatic feeding conveyor. These devices achieve accurate centering of laundry articles by employing clipping means contained in movable carriages as indicated above. The carriages in these prior art devices start from a position located at either side or center of the conveyor. The carriages synchronously move in outward directions from the conveyor center until the entire leading edge of the laundry article has been fully extended and centered over the conveyor surface. A major disadvantage of these prior art devices is the large number of parts and elements employed in achieving the fast and accurate centering and spreading of laundry articles. Because of this complexity, problems are incurred in both the maintenance and replacement of such devices. As a result, the prior art devices are necessarily costly both to operate and maintain and are not as reliable as a more simplified apparatus.

With respect to prior art clipping means or clamps, such systems suffer from additional disadvantages. Thus, for example, when a latching electrical solenoid is used to energize a clamp, past experience has, in fact, proven that such elements are not suitable for providing the clamping forces of 80 to 100 pounds of thrust which is typically desired. Such forces can, of course, be obtained in the course of manually operated spring-loading clamps. A considerable force is necessary to actuate such clamps to a latched condition sufficiently to lock the article against slippage, and a concomitantly large pulse must be delivered to the latching system at these stations to actuate the clamp to a releasing condition. It has proven impractical to make such spring-loaded clamps which are reliable for holding articles of varying sizes and strengths. Moreover, such systems tend to be slow and cumbersome and overly complex.

SUMMARY OF THE INVENTION

This invention provides a laundry article handling apparatus comprising at least one article clamp having fluid pressure operated means for closing the clamp to hold an article therein, means for moving the clamp between article receiving and article release positions, a source of pneumatic pressure having outlet means disposed at said article receiving position, the pneumatic pressure operated means of the clamp having inlet means to cooperate with said outlet means and having means to retain the pneumatic pressure supplied thereto to hold an article in the clamp when separated from the outlet means, and release means to release pneumatic pressure from the pressure operated means to allow the article to be released from the clamp and actuating means at the release position for operating the release means.

Although alternative means of latching the clamps in a closed position will be evident to those skilled in the art, as will alternative means for releasing such latching systems from a closed condition over a range of release stations, the pneumatic approach described herein wherein the clamps are pneumatically energized at the receiving station to maintain this condition until actuated by a simple pressure release valve at the chosen receiving station has significant advantages. First, considerable force can be applied to very large clamping faces. Also, energy can be stored and yet released with a very light contact with a release mechanism. Additionally, pneumatic cylinders are very light and compatible when compared with equivalent energy size, for example, of a latching electrical solenoid. Thus the pneumatic system disclosed is mechanically simpler and reliable than such mechanical or electro-mechanical latches.

In one preferred embodiment of the invention two clamps may be provided each having associated pneumatic pressure operated means for closing the clamp, said outlet means at the receiving position having two outlets for communicating respectively with inlets of the pneumatic pressure operated means of the clamps and said clamp moving means being arranged to move the clamps between said receiving position and two spaced release positions each of which has associated actuating means for releasing fluid pressure from the pneumatic pressure operated means of the respective clamps when the clamps reach said release positions.

In any of the above arrangements the means for moving the clamp or clamps may be arranged to move the clamp or clamps linearly. In an alternative arrangement the means for moving the clamp or clamps may be arranged to move the clamp or clamps through a non-linear path. For example the means for moving the clamp or clamps may be arranged to move the clamp or clamps through a non-linear path.

More specifically the means for moving the clamp or clamps may comprise an endless conveyor for moving the clamp or clamps through said rotary path between article receiving and article release positions.

DESCRIPTION OF THE DRAWINGS

FIG. 2 is a side elevation view of part of the apparatus shown in FIG. 1;

FIG. 3A is a detailed view of part of a pneumatic feed system for the apparatus of FIGS. 1 and 2;

FIG. 3B is a perspective view of the assembly shown in FIG. 3A with probes separated from the gland;

FIGS. 7 is a cutaway side elevation of the principal elements of another embodiment of the invention.

DESCRIPTION OF THE INVENTION

Figure 1:
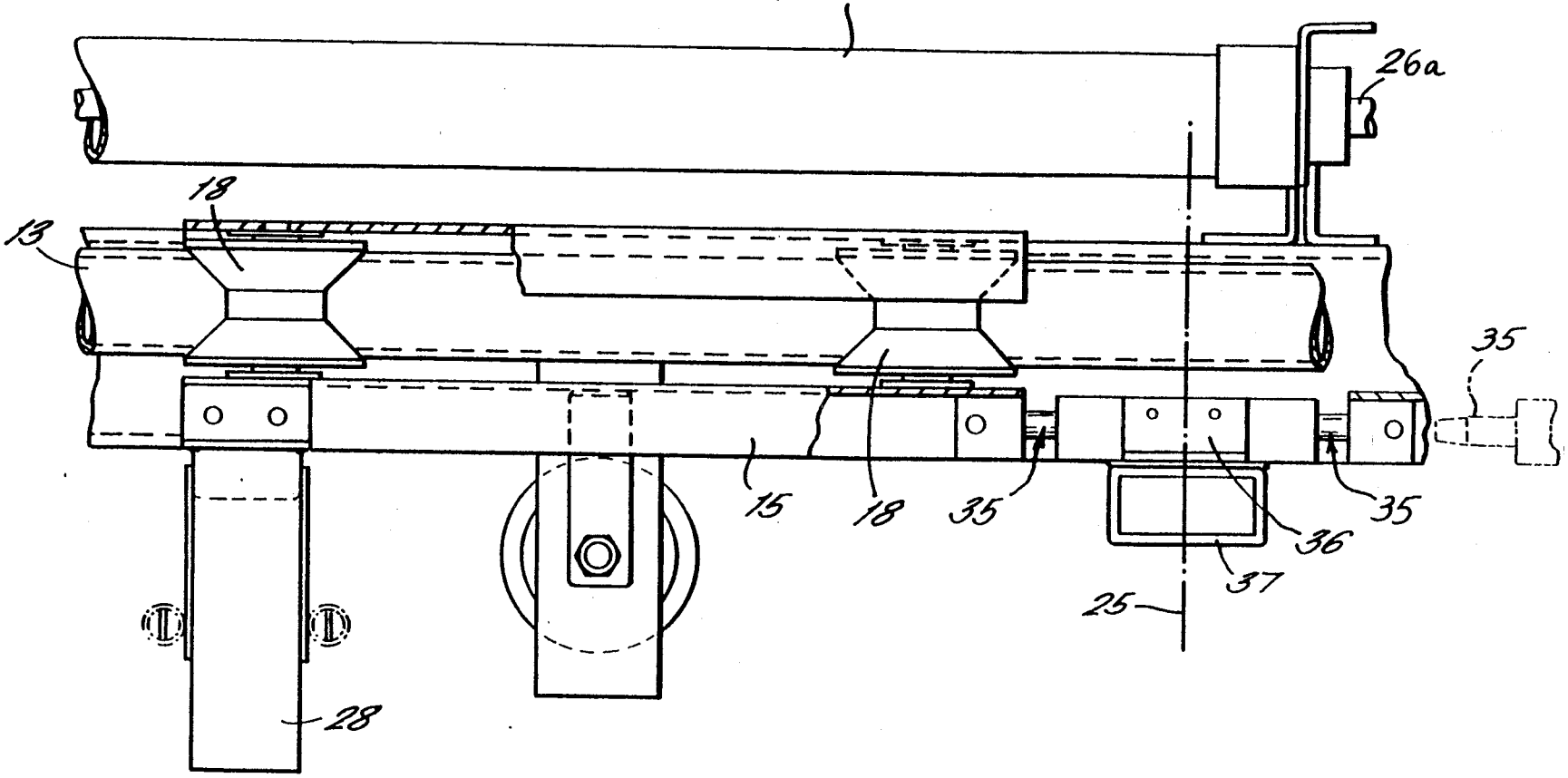
FIG. 1 is a front elevation view of part of a laundry flat-work feeding apparatus.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

The improvements in laundry article handling apparatus to which the present invention relates are applicable generally to laundry article spreading apparatus such as that described and illustrated in my U.S. Pat. No. 4,411,083 the contents of which are incorporated by reference herein. The latter specification discloses an apparatus for centering and spreading laundry articles on the conveyor of a machine, automatically feeding such articles to a commercial laundry iron and comprises leading and trailing carriages having clipping apparatus for clipping adjacent corners of such articles, a track to convey the carriages, and a belt driven by a motor for moving the carriages on the track. The corners of a sheet or other article are attached to the clipping means of the respective carriages with the carriages in close proximity, and the motor drive for the carriages is then actuated to separate the carriages and thereby spread the edge of the sheet spanning the corners ready to be fed into the apparatus.

Referring now to FIGS. 1 and 2 of the drawings, there is shown an article handling apparatus to be disposed in front of a delivery system (not shown) for feeding articles to a subsequent processing station such as an ironing machine. The apparatus comprises a supporting framework indicated generally by the reference numeral 10 (FIG. 2) on which an elongated track is mounted comprising a horizontal flange 11 supported by means of an upright leg 12 on a part of the framework and cylindrical tube 13 mounted on another part of the framework 10 and extending parallel to the flange. The flange 11 and tube 13 form, between them, a track on which a pair of carriages 14 are mounted for linear displacement. Each carriage comprises a pair of interconnected upper and lower horizontal plates 16,17 of inverted channel-section form. Two pairs of diabolo-shaped wheels 18,19 are mounted for rotation between the upper and lower plates at spaced locations along the plates to engage and run along the cylindrical tube 13. A vertical plate 20 is secured midway along one side of the pair of channels to project below the channels. A pair of upper and lower wheels 21,22 are mounted to rotate about spaced horizontal axis 22,23 on hubs 24, one secured to the plate 20 between the channels and the other to the part of the plate depending below the channels. The wheels engage the upper and lower sides of the aforesaid horizontal flange 11 of the track. The carriage 14 is thus guided and constrained for linear horizontal movement along the track formed by the flange 11 and cylindrical tube 13.

The two carriages 14 are displaced linearly along the track from positions immediately to either side of a center line indicated at 25 on FIG. 1 and spaced positions towards the respective ends of the track by a double-acting pneumatic cylinder 26 (FIG. 1) mounted on the frame 10 and having a piston rod 26*a* preferably connected through a system of endless belts to multiply movement of the rod to the respective carriages so as to move the carriages towards and away from each other along the track.

Each carriage has a pneumatically operated clamp indicated generally at 27 on FIG. 2 for securing a corner of a sheet thereto. The clamp comprises a base member 15 (FIG. 2) secured by brackets 15*a* to the lower channel 17. The member is formed with one downturned clamp jaw 28. A housing 30 is secured to the underside of base member 15 in which a pneumatic ram cylinder 29 is mounted. The ram has a piston rod 31 projecting from the cylinder thereof to which a movable jaw 32 is connected to move towards and away from fixed jaw 28. Pneumatic pressure supplied to the cylinder 29 extends the piston rod 31 to engage the movable jaw 32 with fixed jaw 28 to trap a corner of the sheet disposed therebetween. An external tension spring 33 extends between the movable jaw 32 and a fixed anchorage 34 on the cylinder 29 to cause the ram to retract when air pressure is released from the cylinder and thereby release a sheet corner from the clamp. The spring 33 could of course be embodied internally in the cylinder or a double acting cylinder could be utilized.

Each carriage 14 has an injection probe 35 mounted on the carriage on the side thereof facing the center 25 of the track and connected by a nonreturn valve as described below to the rear of the cylinder 29. As best seen in FIGS. 1, 3A and 3B, an air injection gland or dock 36 is mounted at the center of the apparatus on a fixed member 37 of the apparatus and has ports 38,39 facing in opposite directions along the carriage track to receive the respective probes 35 on the carriages when the carriages are adjacent to center of the track. The ports 38,39 each have internal seals 40 to cooperate with the probes. FIG. 3A shows the probes 35 inserted into their respective ports 38, 39, and FIG. 3B shows the probes in a withdrawn condition. FIG. 1 shows in dotted outline the right-most probe 35 in a withdrawn condition. Referring now to the pneumatic circuit of FIG. 4, the gland 36 has an inlet 41 in communication with the ports 38,39 and connected via pneumatic lines to an air pressure supply through a solenoid controlled valve 42.

The orientation shown for clamps 27 is purely illustrative. The major outer surfaces of the clamp jaws 28 in the embodiment shown in FIGS. 1–3 face towards the observer and their travel direction is left and right as indicted in FIG. 4. The solenoid controlled valve 42 is operated by a control system, indicated diagrammatically as 43, which may include a programmable microprocessor control system.

In the preferred embodiment this is accomplished by means of a timer 43A in the control system 43 which actuates the solenoid controlled valve 42 to energize the cylinders 29, immediately after which compressed air is supplied to the double-acting pneumatic cylinder 26 (FIG. 1), resulting in disengagement and rapid separation of the clamps 27 from the receiving station The time necessary for the double-acting cylinder 26 to spread the clamps to their maximum extent is a known value. Accordingly, at the end of this preset time the timer 43*a* actuates the valve actuator 64 in FIG. 4A to open the valves 45 and thus to open the clamps 27.

Thereafter the control system 43 (by means not shown) reverses the air supply to the double-acting pneumatic cylinder 26 to return the clamps 27 to the receiving station. Means for accomplishing the foregoing control operations will be immediately apparent to those knowledgeable in the art.

Figures 4, 4A, 4B:
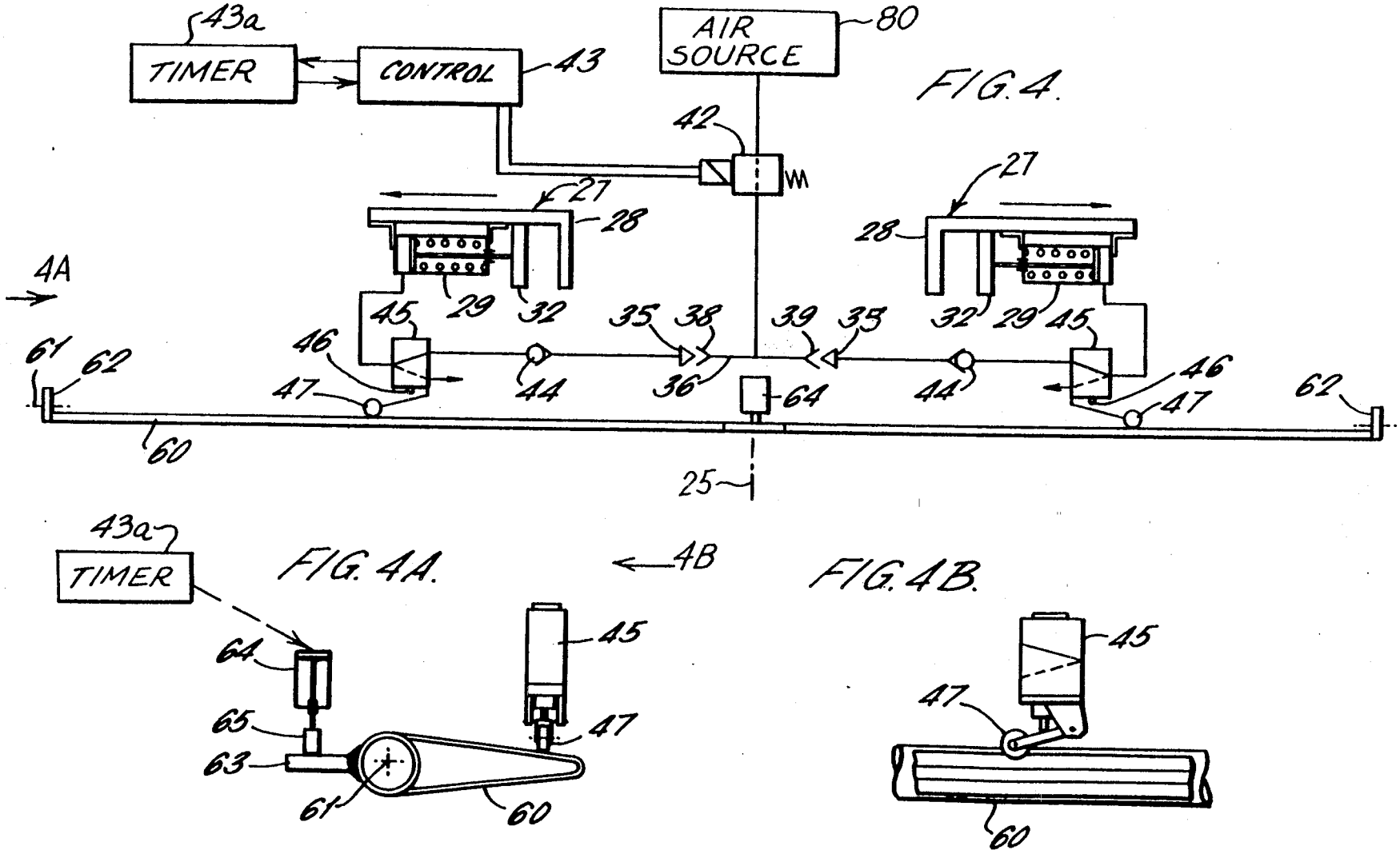
FIG. 4 is a diagrammatic view of a pneumatic circuit for the apparatus of FIGS. 1 to 3.
FIG. 4A is a detailed view of a part of the apparatus indicated by the arrow 4A of FIG. 4.
FIG. 4B is a partial of the apparatus shown in 4A as indicated by the arrow 4B of FIG. 4A.

The probes 35 are connected to the respective cylinders 29 through non-return one-way valves 44 (FIGS. 4, 5, 6) and pressure release valves 45 for releasing air pressure from the cylinders 29 to atmosphere. Each valve 45 is of conventional design having a projecting plunger 46 operable by a pivotally mounted strikers 47 on the valve body. An elongate cam 60 (FIG. 4) extends the length of the track adjacent to the path of the valves 45 on the carriages 14, and is mounted to pivot about a horizontal axis 61 extending along one edge of the cam in end mountings 62. As illustrated in FIG. 4A and 4B, at the center of the cam there is a lever 63 extending laterally of the cam, and a vertically acting pneumatic cylinder 64 has a plunger 65 to engage the lever to pivot the cam upwardly to engage the strikers 47 of the valves 45 to open the valves and thereby release air pressure from the respective cylinders 29.

Thus, when the carriages 14 are adjacent the center 25 of the guide track, air pressure can be supplied from the source through the gland 36 and through the respective probes 35 of the carriages to the cylinders 29 to cause the cylinders to extend and engage the pressure pads thereof with the legs 28. The corners of a sheet to be spread and centered utilizing the apparatus are held captive on the respective carriages. Having engaged the respective corners of the sheet with the clamps, the air supply to the gland 36 is switched off and the pneumatic ram 26 (FIG. 1) for moving the carriages is energized to displace the carriages towards opposite ends of the track to spread the upper edge of the sheet. The pressure in each cylinder 29 is maintained to hold the corners of the sheets in the clamps by reason of the non-return valves 44. When the sheet has been fully spread, the cam is pivoted to trip the strikers 47 of valves 45 to release air from the cylinders 29. The return springs 33 for each of the cylinders retract the movable clamp jaws 32, thereby releasing the corners of the sheet to allow the sheet to be moved onwards in its spread condition to the next stage of the feeding apparatus.

The apparatus described above is particularly suitable for use with an "automatic transfer loading system". This is a system where the clamps are themselves loaded by another mechanism comprising a pair of clips into which the operator has previously loaded the corners of the article. When the clips introduce the corners of the article into the clamps, both clamps are closed simultaneously.

Figure 5:
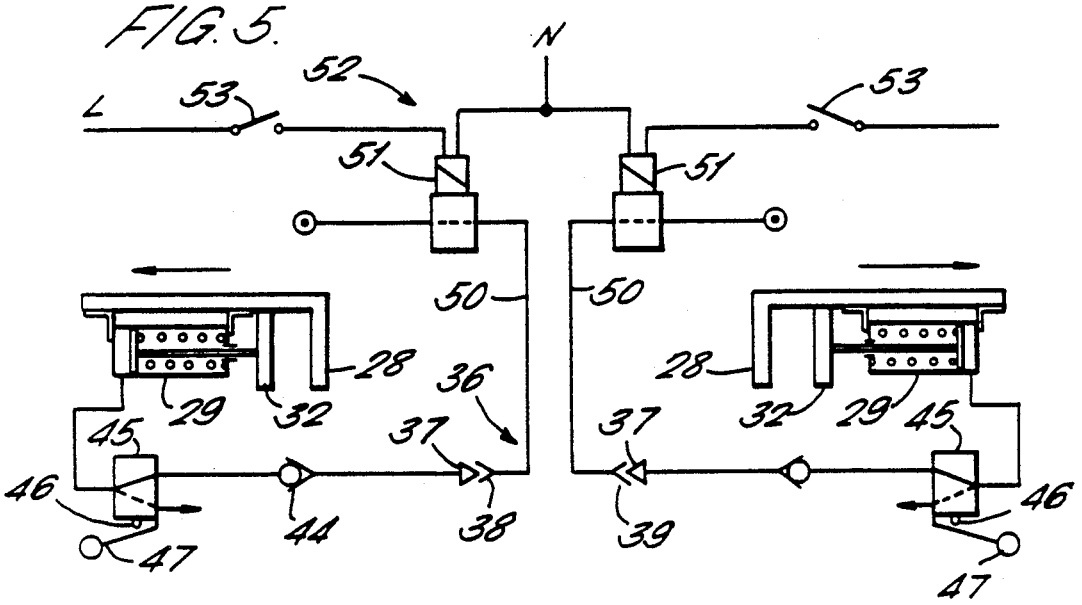
FIGS. 5 and 6 illustrate other forms of circuits.

FIG. 5 shows a variant of the apparatus suitable for manual loading of the clamps by an operator. Generally, the system is the same as that shown in FIG. 4 except that the clamps 29 are arranged to be operable independently and the gland 36 has separate air feeds 50 to the respective ports 38,39 to receive the probes of the clamps. Each air supply 50 has a solenoid control valve 51 connected in a circuit indicated generally at 52 having separate switches 53 for the respective solenoid valve. The switches 53 could of course be replaced by manually operated air valves. Such air valves could be hand triggered or foot controlled.

Figure 6:
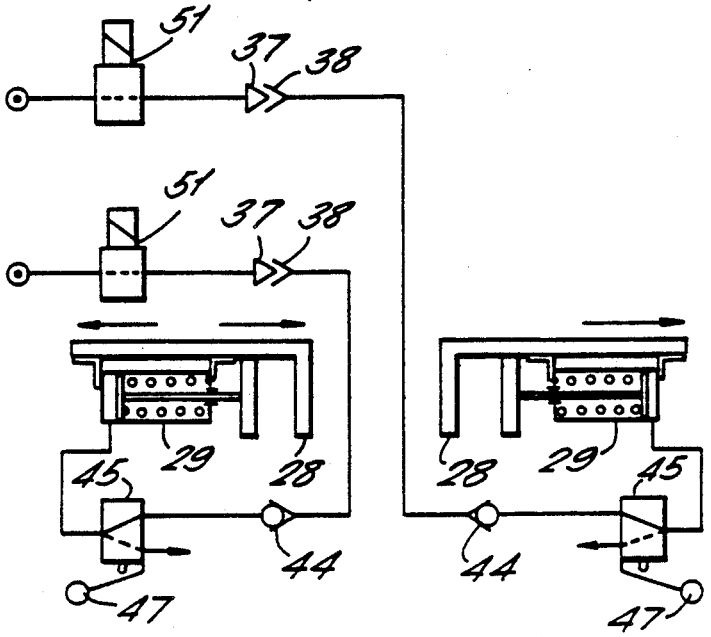

FIG. 6 shows a further variant in which the movable carriages supporting the clamps and circuits make direct contact with the air supply outfeed when they are moved into their loading positions and an "auto engage entry" for use when it is necessary to engage and disengage the air feed from the mechanisms by moving the outlet feed supply to engage with the movable inlet coupling. This method must be used in rotary docking system as described below.

In the above arrangement, the clamps have docked with a centrally positioned gland on the track, and the main compressed air feed outlet to close the clamps is located at the central gland or dock in a position in line with the inlet probes of the respective carriages. When the carriages are moved to the central loading position, the inlet couplings engage with the stationary outlet sections and compressed air can be fed to close the clamps. When the carriages are moved away from the center, the supply is disconnected.

In a further arrangement, a "side" docking arrangement is provided in which the two clamps and their respective carriages are mounted on a track where they are arranged to move to one end of the track for loading. This system permits the use of dual clamping mechanisms sharing a common track with one station at each end. The compressed air feed outlets are located at a side dock or gland situated at each end of the track. The inlet probes are provided on the movable carriages and are arranged to align with the feed outlets of the glands and to connect with them when the carriages are moved to their loading positions.

Figure 8:
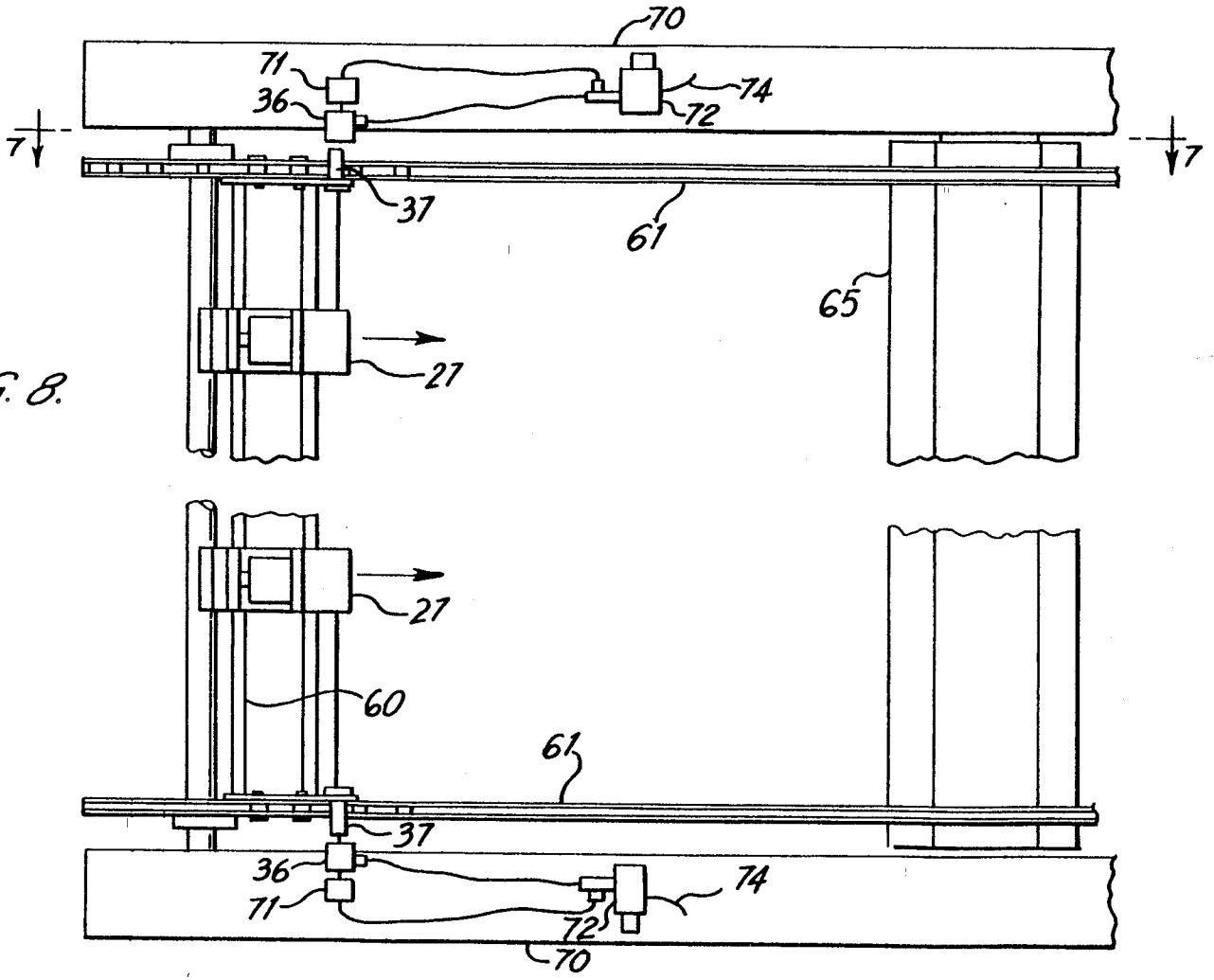
FIGS. 8 is a bottom view of the principal elements shown in FIG. 7.

In a further "rotary" docking arrangement illustrated diagrammatically in FIGS. 7 and 8, pairs of pneumatically operated clamp mechanisms 27 are supported on beams 60 (or tracks, if the clamps in each pair are to move towards and away from one another) which are, in turn, supported at spaced locations on a conveying means comprising a pair of spaced apart endless chains or toothed belts 61. The chains extend around spaced sprockets 62, one of which is driven by a motor through an indexing mechanism to advance the conveyor in predetermined steps to move the clamp carrying beams along a loop-shaped path 82—82 as an endless conveyor between a loading station 63 and a delivery station 64 spaced apart around the conveyor. The clamps 29, together with the non-return valves 44, release valves 45 and inlet probes 37 are all mounted on the beams 60 with the probes projecting outwardly of the conveyor sides. Air glands or docks 36 for the respective clamps are mounted to either side of the conveyor mechanism at the loading station 63 as best seen in FIG. 8 on spring-retracted pneumatic rams 71 connected through solenoid controlled valves 72 to a compressed air supply via liens 74—74. The valves 72 have outlet ports connected to both the air glands 36 and to the pneumatic rams 71. Thus, when valves 72 are opened, air is supplied to the rams 71 which extend and engage the glands 36 on the probes 37. At the same time air is supplied through the glands/probes to the pneumatically closed clamps 27 to hold an article therein. Valves 72 are then set to vent to atmosphere to release air pressure to the rams 36 which then retract the glands 36 from the probes. The non-return valves 44 hold the charge of air pressure supplied to the clamps 27 which therefore remain closed. The next indexing movement of the conveyor mechanism brings the beam 60 into register with the delivery station 64 where a fixed plate 65 engages the strikers 47 of the pressure release valves 45 of the clamps to vent the rams of the clamps to atmosphere to allow the clamps to open. An article held therein is then allowed to transfer to a feed conveyor 66.

Further details of the apparatus for transferring the article from the clamping/spreading apparatus described above to the ironing or other further processing apparatus are to be found in our U.K. Patent Application Nos. 8813109.9 and 8813110.7.

I claim:

1. A laundry article handling apparatus comprising:

fluid pressure operated means;

at least one article clamp connected to said fluid pressure operated means and having clamp closed and open positions respectively when said pressure operated means is pressurized and unpressurized;

clamp moving means for bodily moving said pressure operated means and said clamp connected thereto between an article receiving station and an article release station;

pressure outlet means disposed at said article receiving station and adapted for connection to a source of pneumatic pressure, said pneumatic pressure operated means having inlet means configured for releasable mechanical engagement with said outlet means when said clamp and said pressure operated means are moved to said article receiving station by said clamp moving means and having means for retaining the pneumatic pressure supplied thereto to hold an article in said clamp when said inlet means is disengaged from said outlet means by motion of said clamp and said pressure operated means away from said article receiving station;

release means at said article release station for releasing pneumatic pressure from said pressure operated means to allow said article to be released from said clamp; and actuating means at said release station for operating said release means.

2. An article handling apparatus as claimed in claim 1 wherein two such clamps and associated pneumatic pressure operated means are provided for closing their associated clamps, said clamps being spaced apart from each other along a given clamp axis, individual receiving stations for said clamps for accepting a spread-out article therebetween, said outlet means include two outlets configured for releasable engagement respectively with the inlet means of said pneumatic pressure operated means when said clamps are at their receiving stations, and said clamp moving means include means for moving said pneumatic pressure operated means and the clamps connected thereto away from said receiving stations in a direction generally transverse to said clamp axis and towards two spaced-apart release stations, each of which release stations has said actuating means for releasing fluid pressure from said pneumatic pressure operated means of the respective clamps when said clamps reach said release stations.

3. An article handling apparatus as claimed in claims 1 or 2 wherein said source of pneumatic pressure is stationary with respect to said receiving station or stations.

4. An article handling apparatus as claimed in claim 3 in combination with said source of pneumatic pressure.

5. An article handling apparatus as claimed in claim 2, wherein one of said inlet means and said outlet means at each of said article receiving stations is mounted for reciprocating movement parallel to said clamp axis to engage with and detach from the other of said inlet means and said outlet means when said clamps are at their article receiving stations.

6. An article handling apparatus as claimed in claims 1, 2, or 5 wherein said clamp moving means includes means for moving said clamp or clamps to tour between said receiving stations and said release stations over a generally loop-shaped path.

7. An article handling apparatus as claimed in claim 6, wherein said means for moving said clamp or clamps include an endless conveyor for moving said clamp or clamps around said loop-shaped path.

8. An article handling apparatus as claimed in claim 1 wherein said inlet means of said pneumatic pressure operating means of said clamp includes projecting nozzle means oriented towards said outlet means, and said outlet means includes socket means configured for aligning engagement with said nozzle means when said clamp is at said receiving station for supplying air under pressure to said nozzle means.

9. An article handling apparatus as claimed in claim 1, wherein said means for moving said clamp comprise linearly extending track means, means for mounting said clamp for movement along said track means and means for moving said clamp along said track means.

10. An article handling apparatus as claimed in claim 1 wherein two such clamps disposed spaced apart from each other along a given clamp axis and associated pneumatic pressure operated means are provided for closing their associated clamps at associated receiving stations, and outlet means at said receiving station having outlets configured for releasable engagement respectively with the inlet means of their associated pneumatic pressure operated means when said clamps are at said receiving stations, and said clamp moving means include means for moving said pneumatic pressure operated means and the clamps connected thereto away from said receiving station with said article spread therebetween and towards two spaced-apart release stations, each of which has associated actuating means for releasing fluid pressure from said pneumatic pressure operated means of the respective clamps when said clamps reach said release stations.

11. An article handling apparatus as claimed in claim 10 wherein said clamp moving means is configured so that said receiving stations and said release stations lie generally along a common linear axis.

12. An article handling apparatus as claimed in claim 11, wherein said means for moving said clamps comprise linearly extending track means, means for mounting said clamps for movement along said track means and means for moving said clamps along said track means between said receiving stations and, said release stations.

13. An article handling apparatus as claimed in claim 10 wherein said clamp moving means includes means for moving said clamps in a spread-apart condition with said article spread therebetween in a dispensing direction transverse to said clamp axis and towards said receiving stations.

14. An article handling apparatus as claimed in claim 13, wherein said means for moving said clamps comprise linearly extending track means, means for mounting said clamps to said track means, and means for moving said track means in said dispensing direction to said release stations.

15. The article handling apparatus of claim 13 wherein said release means includes mechanically operable valve means for releasing said pneumatic pressure, and said actuating means includes at least one fixed elongated member disposed generally parallel to said clamp axis and disposed to engagingly operate said valve means upon passage of said clamps to said release stations to release said pneumatic pressure over a range of clamp positions extending along said clamp axis.

16. An article handling apparatus as claimed in claims 10 or 13 wherein said clamp moving means includes means for moving said clamps to tour between said receiving stations and said release stations over a generally loop-shaped path.

17. An article handling apparatus as claimed in claim 16, wherein said means for moving said claps include an endless conveyor for moving said clamps around said loop-shaped path.

18. An article handling apparatus as claimed in claim 13, wherein one of said inlet means and said outlet means at each of said article receiving stations is mounted for reciprocating movement parallel to said clamp axis to engage with and detach from the other of same when said clamps are at their article receiving stations.

19. An article handling apparatus as claimed in claims 13 or 18 wherein said pneumatic pressure operating means of each said clamp includes a pair of projecting nozzle means oriented towards said outlet means, and said outlet means includes a pair of socket means facing in opposite directions and configured for aligning engagement with a different one of said nozzle means when said clamps are at said receiving station for supplying air under pressure to said nozzle means.

20. An article handling apparatus as claimed in claim 10, wherein said outlet means includes means for providing a common air supply to said two outlet means and means for controlling said air supply.

21. An article handling apparatus as claimed in claim 10, wherein said outlet means includes means for providing separate air supplies to said respective outlets and an independently operable control means for controlling each said outlet.

22. An article handling apparatus as claimed in claim 11, wherein said clamp moving means includes means for moving said clamps simultaneously to said receiving stations and to their associated release stations.

23. An article handling apparatus as claimed in claims 1 or 10 wherein said means for retaining pneumatic pressure includes control valve means for admitting the pneumatic pressure supplied to said outlet means to supply air under pressure to said pneumatic pressure operated means when said clamp or clamps are engaged with said outlet means and for closing off the pneumatic pressure supply before said clamp means separate from said outlet means.

24. An article handling apparatus as claimed in claim 10 or 11 wherein said clamp moving means includes means for moving said clamps from a minimum inter-clamp distance to a maximum inter-clamp distance along said clamp axis and characterized by a given time to reach said maximum inter-clamp distance, and said actuating means includes timing means for actuating said release means to operate said clamps to said open positions thereof after an elapsed time greater than said given time.

25. An article handling apparatus as claimed in claim 24 wherein said actuating means for releasing said clamps are stationary with respect to said receiving and release stations and are disposed to extend parallel to said clamp axis to release the pneumatic pressure operated means of said clamps wherever said release stations are set in relation to said receiving station.

26. The article handling apparatus of claim 25 wherein said release means includes mechanically operable valve means for releasing said pneumatic pressure, and said actuating means includes at least one movably mounted elongated member disposed generally parallel to said clamp axis and means for urging said member to engagingly operate said valve means to release said pneumatic pressure over a range of clamp positions extending along said clamp axis.

27. The article handling apparatus of claim 1 wherein said release means includes mechanically operable valve means for releasing said pneumatic pressure, and said actuating means includes at least one movably mounted elongated member disposed to extend between said receiving station and said release station and means for urging said member to engagingly operate said valve means to release said pneumatic pressure over a range of clamp positions extending between said receiving station and said release station.

* * * * *

UNITED STATES PATENT AND TRADEMARK OFFICE

CERTIFICATE OF CORRECTION

PATENT NO. : 4,991,326

DATED : February 12, 1991

INVENTOR(S) : Henry J. Weir

It is certified that error appears in the above-identified patent and that said Letters Patent is hereby corrected as shown below:

The title page should be deleted to appear as per attached title page and ADD MISSING FIGURE 7.

FIG. 7.

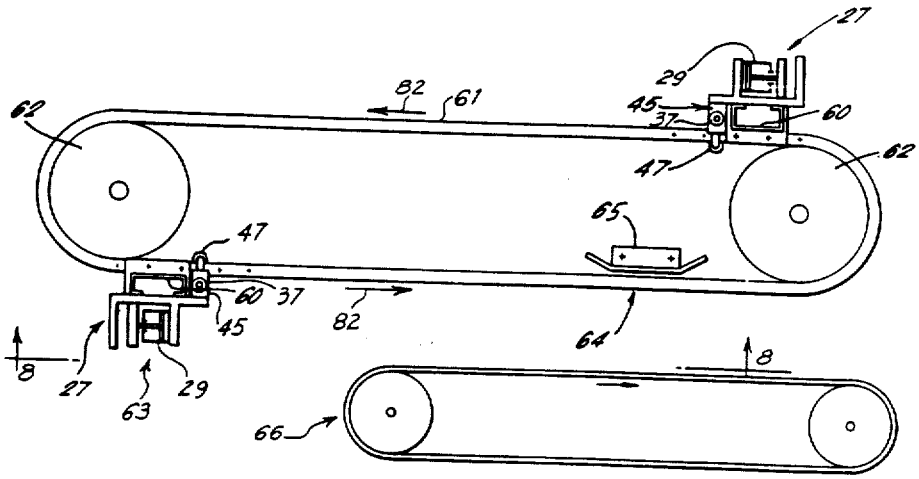

Signed and Sealed this

Eleventh Day of May, 1993

*Attest:*

*Attesting Officer*

Michael K. Kirk

MICHAEL K. KIRK

*Acting Commissioner of Patents and Trademarks*

United States Patent [19]

Weir

[11] Patent Number: 4,991,326

[45] Date of Patent: Feb. 12, 1991

[54] AIR CLAMP FOR LAUNDRY HANDLING APPARATUS

[76] Inventor: Henry J. Weir, The Willows, Woodcroft, Gwent, United Kingdom

[21] Appl. No.: 347,986

[22] Filed: May 5, 1989

[30] Foreign Application Priority Data

Jun. 5, 1988 [GB] United Kingdom ..... 8810683

[51] Int. Cl.[5] ..... D06F 67/04

[52] U.S. Cl. ..... 38/143; 414/751

[58] Field of Search ..... 414/751, 468.2; 198/803.1, 465.1; 26/94; 269/13; 38/8, 12, 143

[56] References Cited

U.S. PATENT DOCUMENTS

| | | | |
|---|---|---|---|
| 4,106,227 | 8/1978 | Allen et al. | 38/143 |
| 4,378,645 | 4/1983 | Allen et al. | 38/8 |
| 4,411,083 | 10/1983 | Weir | 38/143 |
| 4,557,371 | 12/1985 | Yonezawa | 18/803.01 |

FOREIGN PATENT DOCUMENTS

| | | | |
|---|---|---|---|
| 1513669 | 1/1967 | France . | |
| 1105342 | 3/1968 | United Kingdom . | |
| 2098633 | 11/1982 | United Kingdom | 38/8 |
| 2099025 | 12/1982 | United Kingdom | 38/8 |

OTHER PUBLICATIONS

UK Patent Application, No. 8813109.9, Jun. 3, 1988, Weir.

*Primary Examiner*—Andrew M. Falik

*Attorney, Agent, or Firm*—Wallenstein, Wagner & Hattis

[57] ABSTRACT

A laundry article handling apparatus comprises at least one article clamp having a fluid pressure operated for closing a clamp to hold an article therein, a system for moving the clamp between an article receiving an article release position, a source of pneumatic pressure having an outlet disposed at the article receiving position, the fluid pressure operated system having an inlet configured to connect to and disconnect from the outlet to be charged therefrom when so connected thereto, and further having a valving system which will retain the pneumatic pressure supplied thereto after disconnection from the outlet. The valve release system is arranged to release pneumatic pressure from the system at the release position to allow the article to be released from the clamp.

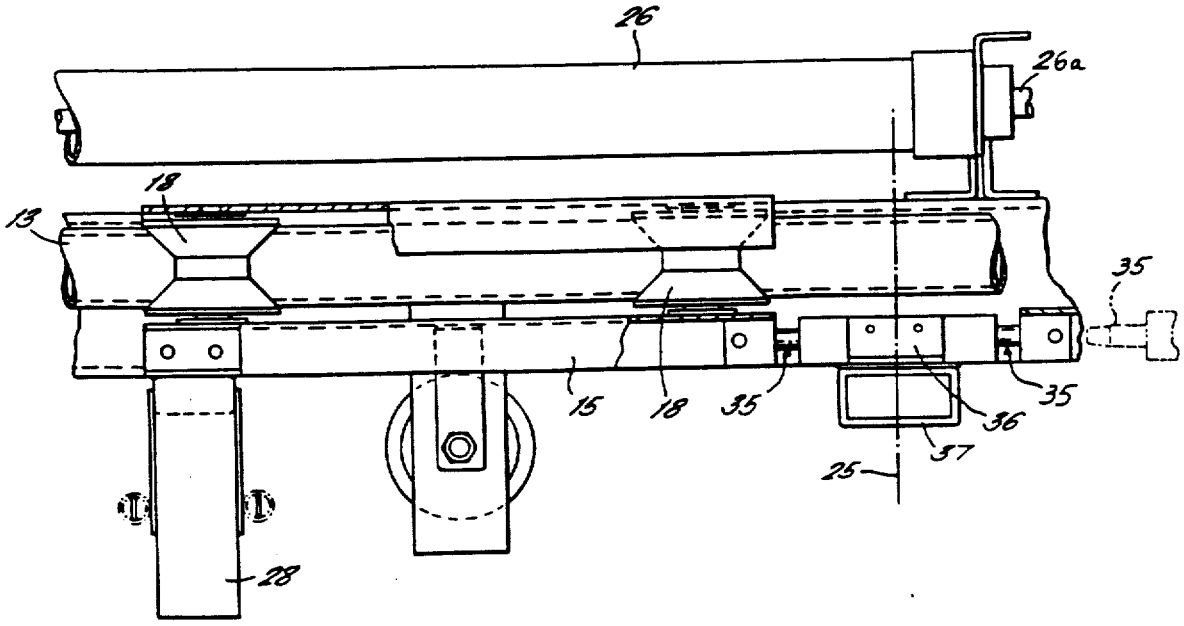

27 Claims, 6 Drawing Sheets